US007857831B2

(12) United States Patent
Ishikawa et al.

(10) Patent No.: US 7,857,831 B2
(45) Date of Patent: Dec. 28, 2010

(54) LIP CLOSING TOOL

(75) Inventors: Hikaru Ishikawa, Tokyo (JP); Mitsuo Iida, Tokyo (JP)

(73) Assignee: Pigeon Corporation, Tokyo (JP)

( * ) Notice: Subject to any disclaimer, the term of this patent is extended or adjusted under 35 U.S.C. 154(b) by 360 days.

(21) Appl. No.: 11/816,684

(22) PCT Filed: Feb. 10, 2006

(86) PCT No.: PCT/JP2006/302378

§ 371 (c)(1),
(2), (4) Date: Sep. 7, 2007

(87) PCT Pub. No.: WO2006/090598

PCT Pub. Date: Aug. 31, 2006

(65) Prior Publication Data

US 2009/0018582 A1 Jan. 15, 2009

(30) Foreign Application Priority Data

Feb. 24, 2005 (JP) ..... 2005-049030

(51) Int. Cl.
*A61J 17/00* (2006.01)

(52) U.S. Cl. ..... 606/234; 128/861

(58) Field of Classification Search ..... 606/234, 606/235, 236; 433/6; 128/859, 860, 861, 128/862

See application file for complete search history.

(56) References Cited

U.S. PATENT DOCUMENTS 2,702,032 A * 2/1955 Freedland ..... 128/861
3,818,906 A * 6/1974 Stubbs ..... 606/234
4,105,032 A 8/1978 Blomstedt
4,986,751 A * 1/1991 Bergersen ..... 433/6
5,052,410 A * 10/1991 Stubbs ..... 128/859

(Continued)

FOREIGN PATENT DOCUMENTS

EP 1169004 A 10/2000

(Continued)

OTHER PUBLICATIONS

International Search Report for PCT/JP2006/302378 (May 16, 2006).

*Primary Examiner*—Todd E Manahan
*Assistant Examiner*—Naquan Ishman
(74) *Attorney, Agent, or Firm*—Kenealy Vaidya LLP

(57) ABSTRACT

A lip closing tool can be configured to encourage an infant or the like to close his/her mouth unconsciously and keep his/her mouth closed, thereby encouraging formation of a habit of nasal respiration. The lip closing tool can include a lip contact portion that is contacted by the outer surface of the lips during use, and a main body that is configured to be disposed inside the oral cavity during use. The main body can include a teeth contact portion that is disposed on the outer surface of the teeth during use and extends in a left-right direction. A thin lip contacting portion can connect the lip contact portion to the teeth contact portion and can be contacted by the upper and lower lips during use. The teeth contact portion can be formed entirely and integrally from a flexible material. Stimulation portions can be provided by enlarging the volume of the teeth contact portion near the end of right and left paths thereof.

13 Claims, 4 Drawing Sheets

U.S. PATENT DOCUMENTS

| | | | | |
|---|---|---|---|---|
| 5,334,218 | A * | 8/1994 | Johnson | 606/235 |
| 5,814,074 | A * | 9/1998 | Branam | 606/234 |
| 6,767,357 | B2 | 7/2004 | Uehara et al. | |
| 6,773,451 | B1 * | 8/2004 | Dussere | 606/235 |

FOREIGN PATENT DOCUMENTS

| | | |
|---|---|---|
| GB | 1516249 | 6/1978 |
| JP | 52-86835 | 7/1977 |
| JP | 03-007144 | 1/1991 |
| JP | 2001190676 | 7/2001 |
| JP | 2001276186 | 10/2001 |
| WO | WO2004/026219 | 4/2004 |

* cited by examiner

LIP CLOSING TOOL

BACKGROUND

This application is a National Stage application filed under 35 U.S.C. § 371 of PCT/JP2006/302378 filed on Feb. 10, 2006 which claims priority to Japanese Patent Application No. 2005-049030 filed on Feb. 24, 2005, which are both hereby incorporated in their entirety by reference.

1. Field

The presently disclosed subject matter relates to a lip closing tool used by an infant at the suckling stage onward or the like to practice closing the lips.

2. Background

A "pacifier" is known widely in the conventional art as a nipple-shaped elastic body that is placed in the oral cavity of an infant from the suckling stage to the weaning stage onward to satisfy the desire of the infant to suck.

The main body of the pacifier, which imitates a mother's nipple, is inserted into the mouth of the infant, thereby stimulating the lips.

A conventional pacifier helps to promote the sucking action of an infant at the suckling stage. Due to the shape of the main body, however, a conventional pacifier may be unsuitable for an infant who has passed the suckling stage and advanced to weaning baby food or normal food.

More specifically, when a pacifier taking the shape of a nipple having a comparatively large sectional diameter is inserted and held in the oral cavity, the mouth is opened comparatively widely, similar to the mouth when receiving mother's milk, thereby hindering practice in keeping the mouth closed, which is behavior desired for the next stage of food intake, language activity, and so on by a growing infant who has begun to lose his/her sucking action. Typically, an infant breathes through the nose with the lips closed. Gradually, as weaning begins, the infant begins to breathe through the mouth when taking food through the oral cavity and when learning how to talk. Depending on the environment, oral respiration may become the principal form of breathing, and therefore a learning process is desirable to form a habit of breathing through the nose.

The present applicant has proposed a pacifier for preventing this and other problems (see Patent Document 1 listed below).

In this application, a pacifier fashioned into a special nipple shape is used to promote holding of the nipple in the oral cavity, thereby enabling effective practice in consciously closing the mouth. Furthermore, by closing the mouth in this manner, the importance of encouraging nasal respiration rather than oral respiration is highlighted.

Also in this application, the part of the nipple that contacts the row of teeth is formed as a comparatively thin hollow body, and by holding a foreign object between the row of teeth for a long time, deterioration of the bite of the front teeth, leading to openbite, can be reduced.

Meanwhile, a practice tool for people who habitually breathe through their mouth, people who have an impaired immune function, and so on, to practice closing the lips tightly to form a habit of breathing through the nose is also known (see Patent Document 2 listed below).

This oral respiration prevention tool has a strip-form vestibular plate formed from a flexible material, and this vestibular plate contacts the outer surface of the occluded teeth. A thin tongue stopper piece is provided via a thin portion of the vestibular plate, and a guide piece is formed so as to project frontward from the vestibular plate.

Thus, the vestibular plate covers the outer peripheral portion of the upper and lower teeth, and therefore the opening portion of the mouth is covered, preventing oral respiration and promoting nasal respiration.

According to the fifth embodiment, for example, a construction in which the tongue stopper piece is connected by a string was disclosed.

Patent Document 1: Japanese Unexamined Patent Application Publication No. 2001-276186

Patent Document 2: Japanese Unexamined Patent Application Publication No. 2001-190676

SUMMARY

The pacifier of Patent Document 1 is for use by an infant at the stage of losing his/her suckling action. Although the part thereof that contacts the row of teeth is formed thinly to reduce open bite, the constitution of the pacifier is similar to that of a synthetic nipple, and therefore, when used by an infant whose milk teeth are beginning to emerge, it may adversely affect the row of teeth.

Further, in the oral respiration prevention tool of Patent Document 2, the vestibular plate covers the outer surface of the row of teeth when the mouth is closed, thereby blocking the opening portion of the mouth and preventing oral respiration. However, this state depends on the user consciously closing his/her lips.

Hence, in the case of an infant or when there is a problem with the lip closing function itself, for example, it is difficult to keep the lips consciously closed, and therefore difficult to form a habit of nasal respiration by inserting this type of nasal respiration prevention tool into the oral cavity. Moreover, the opening portion is closed by the vestibular plate, and therefore, when nasal respiration is difficult or impossible, breathing may be dangerously affected. Furthermore, since the thin tongue stopper piece is made comparatively large so that it can be held in the oral cavity, the thin portion that contacts the row of teeth is also made comparatively large, and this may affect the row of teeth. Furthermore, when string is used, the string may break and be swallowed.

The presently disclosed subject matter has been designed to solve these and other problems, and includes providing a lip closing tool capable of encouraging an infant or the like to close his/her mouth unconsciously and to keep the mouth closed, thereby encouraging the formation of a nasal respiration habit.

A lip closing tool according to a first aspect of the disclosed subject matter can include a lip contact portion that is configured to contact an outer surface of the lips, and a main body that is configured to be disposed inside the oral cavity. The main body can include a teeth contact portion that is disposed on an outer surface of the row of teeth and extends in a left-right direction; and a thin lip contact portion that connects the lip contact portion to the teeth contact portion and is contacted by the upper and lower lips. The teeth contact portion can be formed entirely and integrally from a flexible material, and a stimulation portion can be provided by enlarging a volume of the teeth contact portion near both ends of right and left paths thereof.

According to the disclosed subject matter, the lips of the user are positioned between the lip contact portion, which is contacted by the outer surface of the lips, and the main body, which is disposed in the oral cavity. Therefore, when the user closes his/her mouth, the lip closing tool is held by the closed lips.

The teeth contact portion is formed from a deformable flexible material, and by positioning the teeth contact portion inside the lips and on the outer surface of the row of teeth of the user, the user can be encouraged to close his/her lips while securing sufficient holding force to hold the teeth contact portion tightly inside the oral cavity.

The lip contacting portion integrally connects the lip contact portion to the main body, and is configured to be sandwiched from above and below by the lips of the user, and therefore, when the mouth of the user is closed, the lip closing tool can be maintained securely in a set state. Moreover, the lip contacting portion is thinly formed, and does not therefore obstruct the closed mouth. Thus, respiration through the nasal cavity during breathing can be encouraged.

The stimulation portion is formed by enlarging the volume of the teeth contact portion near both ends of the right and left paths, and is therefore positioned at the back of both the left and right sides of the outer surface of the row of teeth. In this position, the stimulation portion applies pressure to the outer periphery of the row of teeth, the inner surface of the cheek at the periphery of the row of teeth, the alveoli, and so on. By means of this stimulation, the user is caused to close his/her mouth. Hence, when the lip closing tool of the presently disclosed subject matter is positioned correctly in a user's mouth, the user is encouraged to close his/her mouth naturally and unconsciously, and to keep the lips in a closed state. Thus, a habit of closing the mouth in order to breathe through the nose is formed naturally and unconsciously.

In accordance with a second aspect of the disclosed subject matter, the teeth contact portion is formed thinly in a front-rear direction, and the stimulation portion has at least an oval or elliptical cross-sectional form with an up-down direction dimension that is slightly longer than a front-rear direction dimension.

According to the second aspect of the disclosed subject matter, the teeth contact portion is formed thinly in the front-rear direction, and can therefore be held between the outer periphery of the teeth and the inside of the lips, such as the cheeks, appropriately and without discomfort. By providing the stimulation portion with at least an oval or elliptical cross-sectional form with an up-down direction dimension that is larger than the front-rear (horizontal) direction dimension, the stimulation portion is able to provide the desired stimulation while fitting easily between the (front and rear) row of teeth or gums.

In a third aspect of the disclosed subject matter, a tongue contact portion that extends from the vicinity of the center of the teeth contact portion toward the inside of the oral cavity is provided, and a bite portion provided between the tongue contact portion and the teeth contact portion is formed from a thin, flexible material.

According to the third aspect of the disclosed subject matter, during use the tongue of the user contacts the tongue contact portion that extends from the vicinity of the center of the teeth contact portion toward the inside of the oral cavity, and therefore the lip closing tool can be held more reliably. Meanwhile, the bite portion connecting the tongue contact portion to the teeth contact portion is formed from a thin, flexible material near the center, and hence the effect thereof on the teeth can be minimized.

A lip closing tool according to a fourth aspect of the disclosed subject matter can include a lip contact portion that is configured to be contacted by an outer surface of the lips, and a main body that is configured to be disposed inside the oral cavity. The main body can include a teeth contact portion that is configure to be disposed on an outer surface of the row of teeth and extends in a left-right direction; and a thin lip contact portion that connects the lip contact portion to the teeth contact portion and is configured to be contacted by the upper and lower lips. The teeth contact portion can be formed entirely and integrally from a flexible material. The teeth contact portion takes a wide sheet form that is thin in a front-rear direction and has an enlarged dimension in an up-down direction. The wide sheet-form teeth contact portion has a deforming portion that is deformed easily in the up-down direction by providing large penetrating openings in an interior portion thereof.

According to the fourth aspect of the disclosed subject matter, the lip contact portion that is configured to be contacted by the outer surface of the lips and the lip contacting portion can be constituted similar to those same portions of the first aspect of the disclosed subject matter.

However, the teeth contact portion takes a wide sheet form that is thin in the front-rear direction and has an enlarged dimension in the up-down direction, and therefore the upper edge and lower edge thereof enter the indentations in the base end portions of the upper gum and lower gum easily, whereby appropriate stimulation can be applied to close the mouth. Hence, the user can be encouraged to close his/her mouth, and by providing large penetrating openings in the inside of the teeth contact portion that double as a deforming portion that is deformed easily in the up-down direction, the teeth contact portion can be fitted to the outer periphery of the user's row of teeth with greater ease and can be held in an attached state more reliably. Hence, when the above-described lip closing tool is properly positioned in a user's mouth, the user can be encouraged to close his/her mouth naturally and unconsciously and to keep their lips in a closed state. Thus, a habit of closing the mouth in order to breathe through the nose is formed naturally and unconsciously.

DETAILED DESCRIPTION OF EXEMPLARY EMBODIMENTS

Exemplary embodiments of the presently disclosed subject matter will be described in detail below with reference to the attached drawings.

Note that the embodiments to be described below are specific examples of the presently disclosed subject matter, and are therefore subject to various technical features and characteristics. However, the scope of the presently disclosed subject matter is not limited to the specific embodiments described below.

Figure 1:
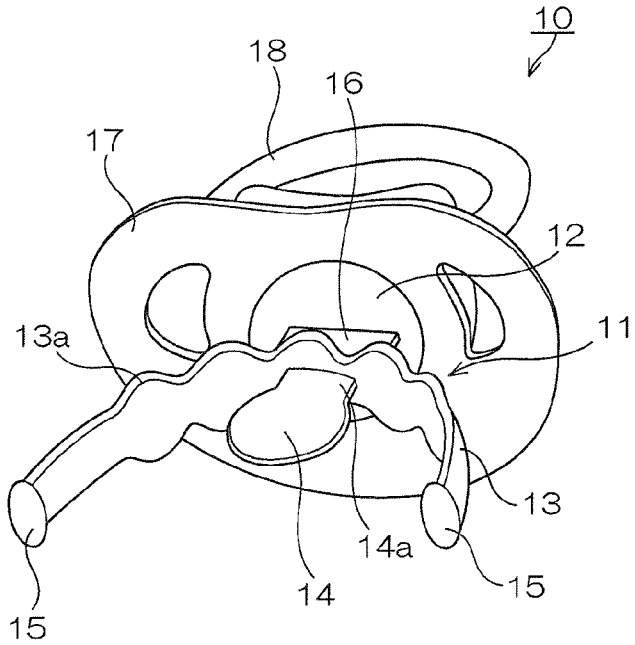
FIG. 1 is a schematic perspective view showing a first embodiment of a lip closing tool made in accordance with principles of the disclosed subject matter.
Figure 2:
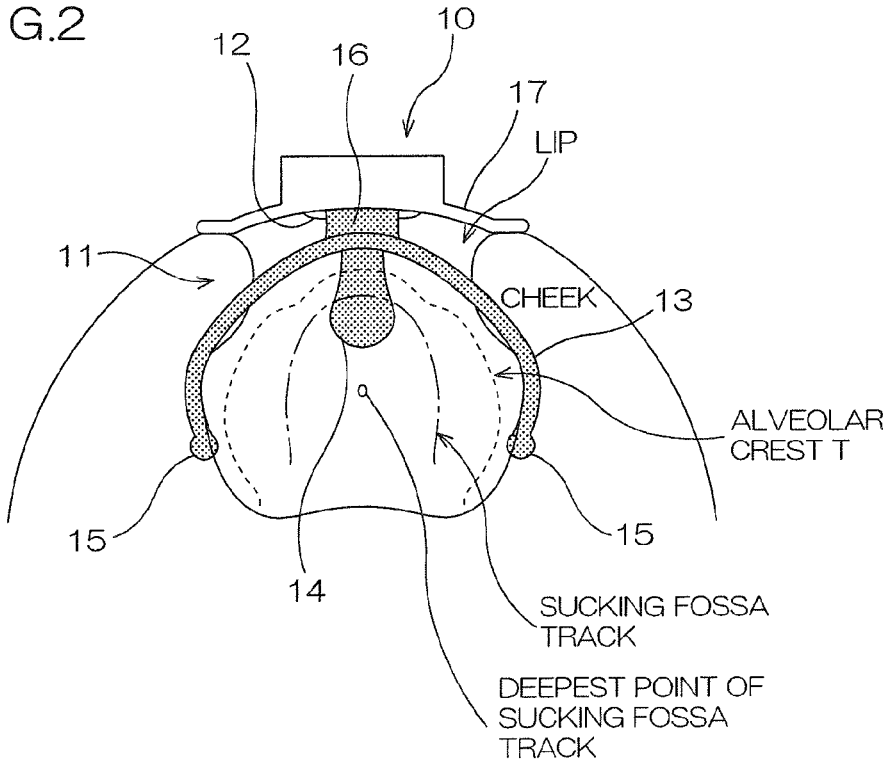
FIG. 2 is a schematic plan view showing use of the lip closing tool in FIG. 1.
Figure 3:
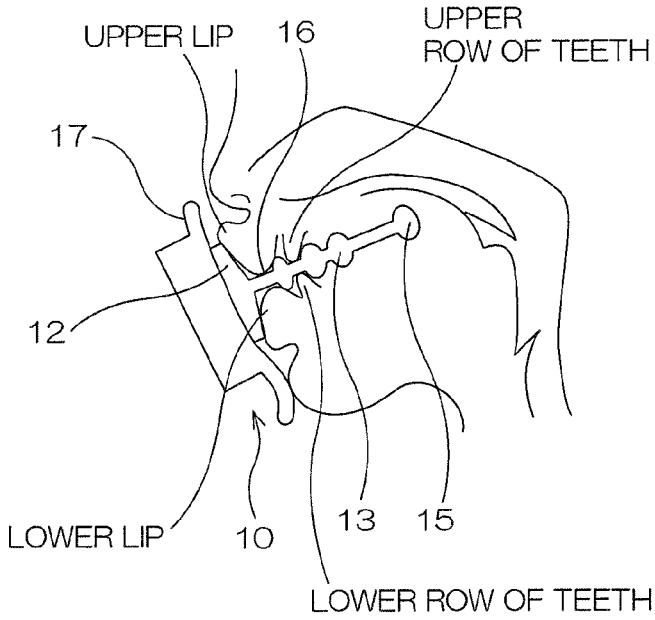
FIG. 3 is a schematic sectional view showing use of the lip closing tool in FIG. 1.

FIG. 1 is a schematic perspective view of an embodiment of a lip closing tool made in accordance with principles of the disclosed subject matter, FIG. 2 is a schematic plan view showing the lip closing tool of FIG. 1 inserted into a user's oral cavity, and FIG. 3 is a schematic longitudinal sectional view showing the lip closing tool of FIG. 1 inserted into the user's oral cavity.

A lip closing tool 10 may be used by an infant from the suckling stage to the weaning stage or an adult who desires lip function practice to acquire the skill of nasal respiration. However, the following description of specific embodiments focuses on a case in which the lip closing tool 10 is used by an infant.

FIG. 1 is a schematic perspective view showing an embodiment of a lip closing tool 10 with the mouth rear side facing forward.

In the drawing, the lip closing tool 10 comprises a main body 11 that is inserted into the oral cavity, and a lip contact portion 12 that contacts the outside (outer surface) of the user's lips at the outside of the oral cavity, as shown in FIG. 2 in particular. Further, a shield 17 is provided to prevent the entire lip closing tool 10 from being taken into the oral cavity and swallowed. A grip portion 18 can be pivotably connected to the shield 17 at an outer surface of the shield 17 to form a handle for the lip closing tool 10, enabling easy handling thereof.

Parts of the lip closing tool 10 other than the main body 11 and the lip contact portion 12, such as the shield 17, are formed from a comparatively hard synthetic resin such as polypropylene, for example. The main body 11 and lip contact portion 12 are formed integrally from a flexible material that is not harmful to humans. A soft, flexible material such as silicone, elastomer, or soft rubber may be used as a soft synthetic resin, for example. The lip closing tool 10 may be molded integrally through insert molding (including continuous injection molding and multi-color molding) or the like using these different materials. Alternatively, the parts of the lip closing tool 10 may be engaged and fixed non-detachably.

In the lip closing tool 10, the lip contact portion 12 has a size and shape enabling it to be disposed at the outer surface of the lips and in contact with the front surface of the lips, for example, and may be designed simply as a circular portion having a predetermined diameter.

As shown in FIGS. 2 and 3, a flexible and extremely thin lip contact portion 16 extends integrally from the back surface of the central region of the lip contact portion 12, and is connected to the lip contact portion 12.

The thin lip contact portion 16 has a thin plate shape, and is formed at a thickness of 2 mm or less, for example, to ensure that when the thin lip contact portion 16 is sandwiched between the upper lip and lower lip, as shown in FIG. 3, the gap formed thereby is as small as possible.

The main body 11 is provided with a teeth contact portion 13. As shown in FIG. 1, the teeth contact portion 13 extends in a left-right direction (horizontal direction), and can be formed in a gently curving, deformable semi-arc or semi-ellipse shape that protrudes frontward in accordance with the curved surface of a user's row of teeth. Further, in this embodiment, the teeth contact portion 13 is formed in a strip shape having a reduced thickness dimension in the front-back direction, for example. The teeth contact portion 13 has a thickness of no more than 2 mm and a width of no more than 7 mm, for example, and is fitted along the outside of the teeth. Wave-form convex portions 13*a* can be formed in a plurality of locations on the upper and lower surfaces thereof.

Furthermore, in this embodiment, stimulation portions 15 are formed near both of the terminal extension ends of the left-right extending teeth contact portion 13.

The stimulation portions 15 can have an identical shape, and therefore one of them will be described as a representative example.

When the lip closing tool 10 is set in the oral cavity as shown in FIGS. 2 and 3, the stimulation portion 15 stimulates the inner surface of the oral cavity in at least a different manner to the teeth contact portion 13. More specifically, when the lip closing tool 10 is set within the oral cavity, pressure and a contact sensation are applied to the peripheral tissue by the existence of the stimulation portion 15.

To exhibit this function, the stimulation portion 15 is a bulbous bulging-out portion that is formed integrally with the teeth contact portion 13 by increasing the volume of the teeth contact portion 13 at the end portion thereof.

More specifically, the bulbous stimulation portion 15 may be spherical, but in this embodiment has a vertical elliptical or oval cross-section corresponding to the strip-form teeth contact portion 13, the width of which is at least greater than the thickness of the teeth contact portion 13. For example, the width of the stimulation portion 15 is no less than 3 mm, and the length is no less than 5 mm. Note that the distance between the stimulation portions 15, i.e. the length of the teeth contact portion 13, may be set in accordance with the body shape of the user. When used by an infant, for example, the distance may be set at approximately 85 mm.

In this embodiment, a tongue contact portion 14 comprises a bite portion 14*a* extending rearward from the back of the teeth contact portion 13, and takes a substantially circular tongue shape that increases in width at the extension end thereof. The bite portion 14*a* is narrower than the lip contacting portion 16, and has a width of no more than 10 mm and a thickness of no more than 2 mm, for example. Note that in this embodiment, the bite portion 14*a* is formed to extend horizontally, but may incline upward toward the tongue contact portion 14 to reduce the effect thereof on the front teeth.

When the lip closing tool 10 is inserted into the user's oral cavity, the tongue contact portion 14 contacts the tongue and provides stimulation such as a sense of using the tongue to deform the tongue contact portion 14. This encourages the infant to accept and hold the lip closing tool 10. The tongue contact portion 14 can also be moved up and down by the tongue. In cases where the lip contact portion 12, shield 17, and so on are heavier than those structures to the rear of the thin lip contact portion 16, the main body 11 may fall out of the oral cavity easily unless it is held tightly. However, by providing the tongue contact portion 14 in such cases, this problem can be effectively prevented.

This embodiment is constituted as described above, and when in use, the grip portion 18 shown in FIG. 1 is gripped by the fingers, whereby the main body 11 of the lip closing tool 10 can be inserted into the oral cavity of the user.

FIGS. 2 and 3 show cases in which the lip closing tool 10 is used by an infant at the weaning stage, whose milk teeth are beginning to emerge and who is gradually losing their Sucking Fossa in their upper palate.

More specifically, as shown in FIGS. 2 and 3, the main body 11 of the lip closing tool 10 is inserted into the oral cavity and the mouth is closed such that the lip contact portion 12 is positioned on the outside of the lips. By closing the upper lip and lower lip in this state, the extremely thin lip contact portion 16 is sandwiched between the upper lip and lower lip such that the mouth is closed with substantially no opening between the upper lip and lower lip.

As shown in FIG. 2, the teeth contact portion 13 of the lip closing tool 10 is positioned inside the lips of the user and on the outside of the alveoli, i.e. the outside of the user's row of teeth. In the case of an infant whose teeth have emerged or an adult having permanent teeth, the teeth contact portion 13 is disposed on the outside of the row of teeth so as to extend to the left and right. In the case of an infant whose teeth have not yet emerged or an adult who has lost all or a part of his/her teeth, the teeth contact portion 13 fits the row of teeth outer surface on the outside of the gums so as to extend to the left and right. Thus, the mouth is closed and the lip closing tool 10 is easily held within the mouth cavity.

In this embodiment, the stimulation portions 15 are disposed near both ends of the teeth contact portion 13. As shown in FIGS. 2 and 3, the stimulation portions 15 are positioned near the back side on the outside of the row of teeth, or in other words near the outside of the rearmost tooth. Thus, the stimulation portions 15 are sandwiched between the back teeth and the cheek on the inside of the cheek. As described above, each stimulation portion 15 has a curved elliptical surface, and this curved surface applies pressure stimulation to the corresponding locations of the cheek from the inside.

The present inventors have confirmed through observation and the like that when stimulation is applied to these locations, the user naturally closes the mouth, and therefore, when the lip closing tool 10 of this embodiment is attached, the user is encouraged to close his/her mouth naturally and unconsciously and to keep the lips in a closed state. Thus, a habit of closing the mouth in order to breathe through the nose can be obtained unconsciously and naturally.

Figure 4:
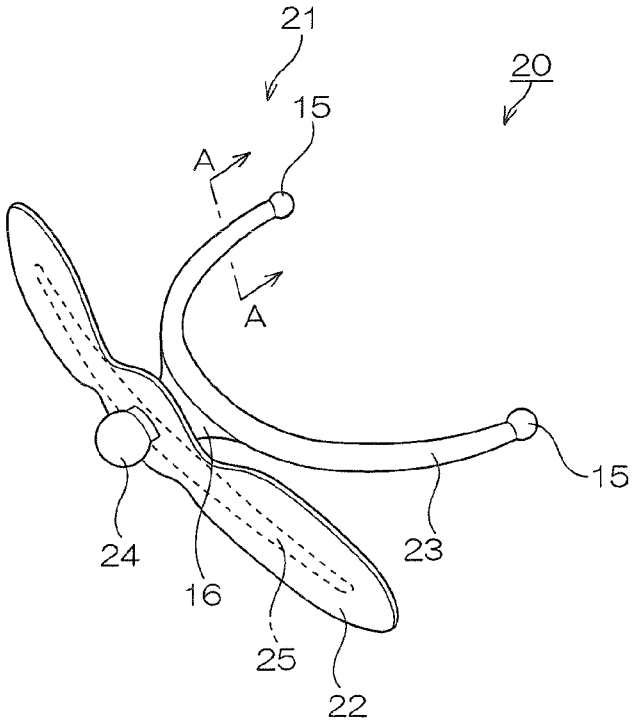
FIG. 4 is a schematic perspective view showing a second embodiment of a lip closing tool made in accordance with principles of the disclosed subject matter.
Figure 5:
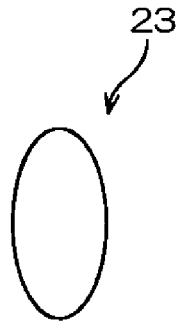
FIG. 5 is an end view taken along line A-A in FIG. 4.

Furthermore, by providing the tongue contact portion 14, the tongue of the infant receives stimulation from the tongue contact portion 14. This stimulation encourages the infant to keep his/her lips closed and to keep hold of the lip closing tool 10. By providing the thin bite portion 14*a*, effects on the row of teeth can be minimized. FIGS. 4 and 5 show a second embodiment of a lip closing tool 11 made in accordance with principles of the disclosed subject matter. FIG. 4 is a schematic perspective view of a lip closing tool according to the second embodiment, and FIG. 5 is an end view taken along a line A-A in FIG. 4.

In FIG. 4, a lip closing tool 20 comprises a main body 21, a lip contact portion 22, and a grip portion 24. The main body 21 comprises a teeth contact portion 23, the stimulation portions 15, and the thin lip contact portion 16.

Here, parts having the same name exhibit substantially identical functions to their counterparts in the first embodiment, and parts having the same reference symbol have common constitutions. Duplicate description of these parts has been omitted, and the following description will focus on differences between the two embodiments.

In this embodiment, almost the entire lip closing tool 20 is formed from a particularly flexible material, principally silicone, for example.

Similar to the first embodiment, the teeth contact portion 23 is configured to be set in a user's mouth cavity in the position illustrated in FIG. 2, and exhibits a similar function. However, the teeth contact portion 23 has a smaller width in the up-down direction and a greater thickness in the front-rear direction than its counterpart in the first embodiment. Further, as shown in FIG. 5, the teeth contact portion 23 has a vertical oval or elliptical cross-sectional shape with a short diameter in the front-rear direction such that the mouth is not closed completely thereby.

The lip contact portion 22 exhibits a similar function to the shield 17 of the first embodiment, and is formed with an enlarged width in the up-down (vertical) direction so as to extend to the left and right (horizontally) from the thin lip contact portion 16. The lip contact portion 22 takes the form of a strip that varies in up-down width in the left-right direction, and is formed from an extremely flexible material. Further, a shape holding material 25 is housed in an interior housing space of the lip contact portion 22. The shape holding material 25 is a material such as a flexible thin plate-form metal plate or the like, for example, which is capable of deformation and of maintaining a deformed shape. The grip portion 24 of this embodiment is spherical.

Note that no tongue contact portion is provided in this embodiment.

Since the tongue contact portion does not exist, when the mouth is closed, the gap that is formed between the upper and lower row of teeth by the bite portion 14*a* in FIG. 1 does not exist, and therefore a perfect bite with no gaps can be achieved.

This embodiment is constituted as described above, and exhibits similar actions and effects to the first embodiment. Moreover, the lip contact portion 22 that is configured to be disposed on the outside of the lips of the user is elongated horizontally, can be deformed to match the outer form of the lips and so on, and can maintain the deformed shape.

Hence, with a comparatively simple constitution, the lip contact portion 22 of the lip closing tool 20 can be aligned with the outer form of the lips of the user, leading to an improvement in fitting comfort. This, in conjunction with the stimulation portions 15, encourages the user to close his/her mouth, and therefore the lip closing tool 20 is suitable for promoting nasal respiration in adults, older children, and so on.

Note that the shape holding member 25 may be made from a shape memory alloy and set in a shape that matches the outer shape of the lips of the user by the body temperature of the user, for example.

Figure 6:
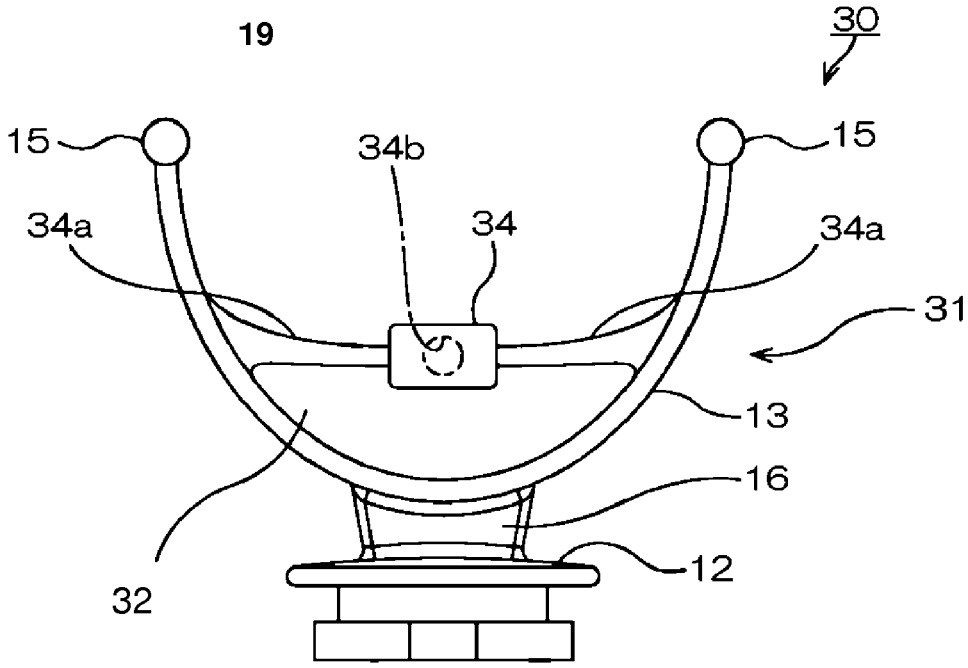
FIG. 6 is a schematic plan view showing a third embodiment of a lip closing tool made in accordance with principles of the disclosed subject matter.

The shape holding member 25 may also be exposed on the outside of the lip contact portion 22. FIG. 6 is a schematic plan view showing a third embodiment, in which the shield 17 of the first embodiment is removed.

In FIG. 6, a lip closing tool 30 is formed from a similar material to that of the first embodiment, and comprises a main body 31 and the lip contact portion 12. The main body 31 comprises the teeth contact portion 13, the stimulation portions 15, the lip contacting portion 16, and a tongue contact portion 34.

Here, parts having the same name exhibit substantially identical functions to their counterparts in the first embodiment, and parts having the same reference symbol have common constitutions. Duplicate description of these parts has been omitted, and the following description will focus on differences between the two embodiments.

In the lip closing tool 30 according to the third embodiment, the tongue contact portion 34 differs greatly from the first embodiment.

In comparison with the tongue contact portion 14 of the first embodiment, the tongue contact portion 34 is thicker, has a greater surface area, and is disposed further toward the rear (in a direction heading away from the lip contact portion 12). More specifically, the tongue contact portion 34 is rectangular, for example, and has thin strip-form support portions 34*a* that extend to the left and right from the side faces thereof and are connected integrally to the inside of the teeth contact portion 13. Further, the tongue contact portion 34 can be moved up and down by the tongue.

When the lip closing tool 30 is inserted into the oral cavity and the mouth is closed, the support portions 34*a* are positioned so as to fit between the canines of the user and the adjacent teeth thereto, and are not sandwiched between the upper and lower row of teeth.

Further, the tongue contact portion 34 is supported from both side portions, and therefore a "bite portion" such as that of the first embodiment is not provided at the front of the tongue contact portion 34. Thus, a large opening 32 into which the front teeth of a user can enter is formed.

Further, the tongue contact portion 34 is provided with a convex portion 34*b* that projects from the surface of the tongue contact portion 34 and applies sensory stimulation to the tongue.

The third embodiment is constituted as described above, and is capable of exhibiting similar actions and effects as compared to the lip closing tool of the first embodiment.

When the lip closing tool 30 is set in the oral cavity, the tip of the user's tongue contacts the comparatively large tongue contact portion 34 and can move the tongue contact portion 34 up and down. Thus, in addition to the effects of the stimulation portions 15, closing of the mouth is promoted even further.

Figure 7:
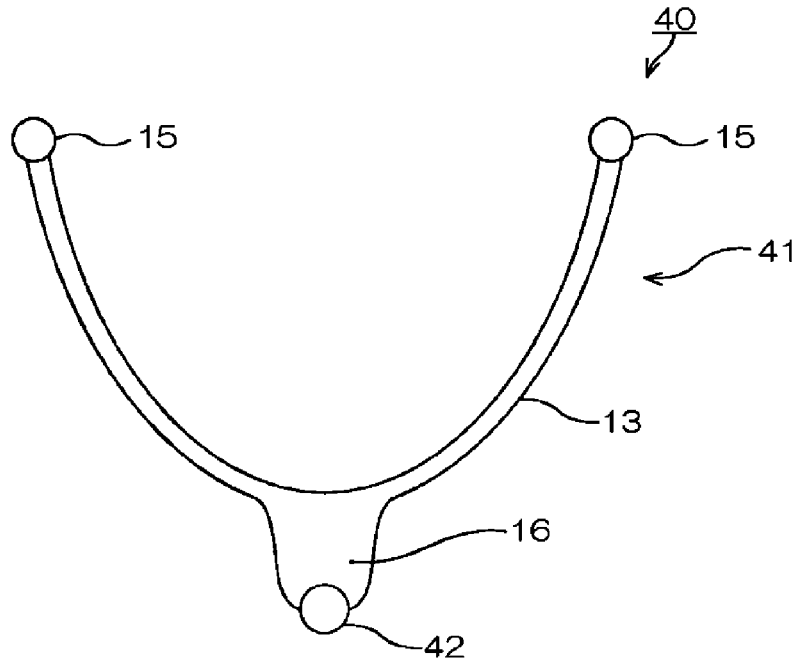
FIG. 7 is a schematic plan view showing a fourth embodiment of a lip closing tool made in accordance with principles of the disclosed subject matter.

Moreover, in this state, the front teeth of the upper and lower row of teeth pass through the large opening 32 to form a perfect bite. Because the support portions 34*a* also fit between the teeth, no gap is formed between the upper and lower row of teeth. As a result, the user can practice keeping the lips in a tightly closed state. FIG. 7 is a schematic plan view showing a fourth embodiment of a lip closing tool.

In FIG. 7, a lip closing tool 40 is formed entirely from a similar material to that of the second embodiment, for example, and comprises a main body 41 and a lip contact portion 42. The main body 41 comprises the teeth contact portion 13, the stimulation portions 15, and the thin lip contact portion 16.

Here, parts having the same name exhibit substantially identical functions to their counterparts in the first embodiment, and parts having the same reference symbol have common constitutions. Duplicate description of these parts has been omitted, and the following description will focus on differences between the two embodiments.

The lip contact portion 42 doubles as a grip portion. More specifically, the lip contact portion 42 is positioned on the outside of, and in contact with, the lips, and is formed with a sphere such as that shown in the drawing, for example, which functions as a grip portion for gripping the lip closing tool 40.

The teeth contact portion 13 may be structured identically to the corresponding location and structure shown in the first embodiment or identically to the corresponding location and structure in the second embodiment.

Figure 8:
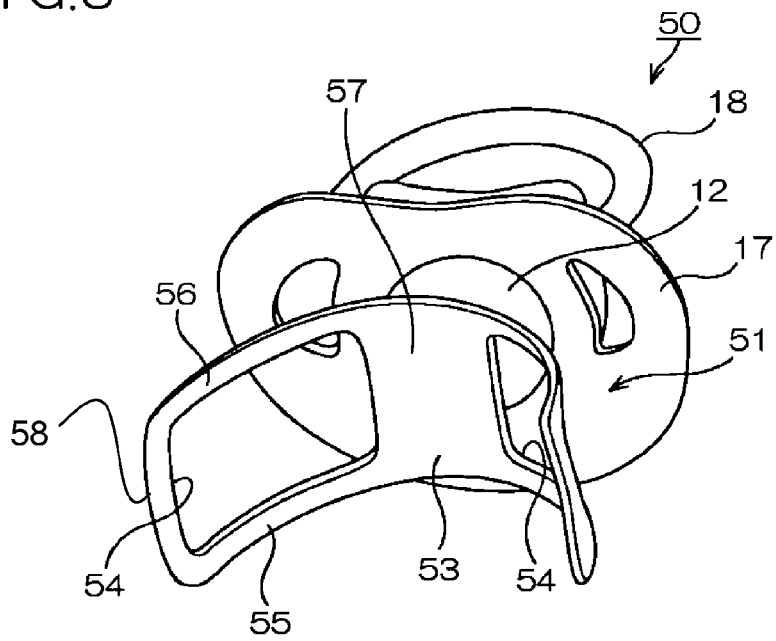
FIG. 8 is a schematic perspective view showing a fifth embodiment of a lip closing tool made in accordance with principles of the disclosed subject matter.

As described above, the lip closing tool 40 of this embodiment is identical to the lip closing tool 20 of the second embodiment with the removal of the lip contact portion 22, and hence the lip closing tool 40 has the simplest constitution. However, the stimulation portions 15 are provided near the both end portions of the teeth contact portion 23, and therefore substantially identical actions and effects to those of the first embodiment can be exhibited, and the lip closing tool 40 can be used unobtrusively by an adult outside of the home or the like, for example. FIG. 8 is a schematic perspective view showing a fifth embodiment of a lip closing tool made in accordance with principles of the disclosed subject matter.

In FIG. 8, a lip closing tool 50 is formed entirely from a similar material to the lip closing tool 10 of the first embodiment, for example.

The lip closing tool 50 comprises a main body 51, the lip contact portion 12, the shield 17, and the grip portion 18, and is constituted identically to the lip closing tool 10 of the first embodiment except for the main body 51. Parts having the same reference symbol have common constitutions, and duplicate description of these parts has been omitted. Accordingly, the following description will focus on differences between the two embodiments.

The main body 51 comprises a thin lip contact portion not shown in the drawing (but constituted identically to that of the first embodiment), and a teeth contact portion 53. A tongue contact portion is not provided.

The teeth contact portion 53 takes a wide sheet form that is thin in the front-rear direction and has an enlarged dimension in the up-down direction. In this embodiment, the wide sheet-form teeth contact portion 53 is provided with large, penetrating rectangular openings 54 on either side of a central portion 57.

The teeth contact portion 53 is shaped identically on either side of the central portion 57, and therefore the constitution of the left side of the drawing will be described.

The region surrounding the opening 54 takes the form of a rectangular frame having a narrow upper frame 56 and a narrow lower frame 55 that are connected integrally by a side portion frame 58 formed on the side portions thereof and having a substantially identical width thereto. The entire frame structure serves as a deforming portion or deforming body that can be deformed particularly easily in the up-down direction of the drawing.

When the main body 51 of the lip closing tool 50 is inserted into the oral cavity of a user and the mouth is closed, the teeth contact portion 53 is disposed in contact with the outside of the user's row of teeth, similar to the teeth contact portion 13 shown in FIG. 2.

In this state, the upper edge of the upper frame 56 and the lower edge of the lower frame 55 enter the indentations in the base end portions of the upper gum and lower gum. Thus, appropriate stimulation is applied near the base of the upper gum and lower gum, and therefore, similar to the stimulation portions 15 of the first embodiment, the user can be encouraged to close his/her mouth.

Further, as described above, the frame structure doubles as a deforming portion for deforming the teeth contact portion 53 in the up-down direction of the drawing, and therefore, when the teeth contact portion 53 is inserted into the user's oral cavity, it can be deformed in the up-down direction such that the up-down direction dimension thereof is reduced. As a result, the upper edge of the upper frame 56 and the lower edge of the lower frame 55 can be easily inserted into the indentations at the base end portions of the upper gum and lower gum, respectively. Following insertion, the teeth contact portion 53 regains its shape due to its elasticity, and therefore the teeth contact portion 53 can be fitted onto the outer periphery of the row of teeth even more comfortably and reliably.

The fifth embodiment is constituted as described above. When the lip closing tool 50 is properly positioned in a user's oral cavity, the user is encouraged to close his/her mouth naturally and unconsciously, and in this state, the user can keep his/her lips closed without feeling a sense of fatigue from closing his/her mouth consciously. Thus, a habit of keeping the mouth closed in order to breathe through the nose is formed unconsciously and naturally.

The constitutions described in the above embodiments may be partially omitted or replaced by other constitutions as desired, and different constitutions may be combined without departing from the spirit and scope of the invention.

The invention claimed is:

1. A tool for closing upper and lower lips located adjacent an oral cavity and row of upper and lower teeth of a user, comprising:

a lip contact portion that is configured to be contacted by an outer surface of the lips of the user; and a main body that is configured to be disposed inside the oral cavity of the user, wherein the main body includes, a teeth contact portion that is configured to be disposed on an outer surface of the row of teeth and extends in a left-right direction, and a thin lip contact portion that connects said lip contact portion to said teeth contact portion and is configured to be contacted by the upper and lower lips, wherein said teeth contact portion is formed entirely and integrally from a flexible material, and a bulbous stimulation portion having an enlarged volume relative to said teeth contact portion and located at an end of right and left paths of the teeth contact portion.

2. The tool according to claim 1, wherein said teeth contact portion is formed thinly in the front-rear direction, and said stimulation portion has at least one of an oval and elliptical cross-sectional form with the up-down direction dimension that is slightly longer than the front-rear direction dimension.

3. The tool according to claim 2, further comprising:

a tongue contact portion that extends from a vicinity of a center of said teeth contact portion toward the inside of the oral cavity, wherein a bite portion located between said tongue contact portion and said teeth contact portion is formed from a thin, flexible material.

4. The tool according to claim 1, further comprising:

a tongue contact portion that extends from a vicinity of a center of said teeth contact portion toward the inside of the oral cavity, wherein a bite portion located between said tongue contact portion and said teeth contact portion is formed from a thin, flexible material.

5. The tool according to claim 1, wherein the teeth contact portion has a first surface formed with a plurality of semi-arc shapes.

6. The tool according to claim 5, wherein the teeth contact portion has a second surface that is opposite from the first surface of the teeth contact portion, the second surface formed with a plurality of semi-arc shapes.

7. The tool according to claim 1, further comprising:

a tongue contact portion; and a plurality of support portions extending from an inward side of the teeth contact portion to the tongue contact portion.

8. The tool according to claim 7, wherein the tongue contact portion is rectangular.

9. The tool according to claim 7, wherein the teeth contact portion is generally U-shaped with a left arm and a right arm, and the plurality of support portions and the tongue contact portion connect the left arm and the right arm to each other.

10. The tool according to claim 9, wherein the tongue contact portion and the plurality of support portions extend from the left arm and the right arm of the teeth contact portion to define a large opening portion at a bottom of the U-shaped teeth contact portion.

11. A tool for closing upper and lower lips located adjacent an oral cavity and row of upper and lower teeth of a user, comprising:

a lip contact portion that is configured to contact an outer surface of the lips; and a main body portion that is configured to be disposed inside the oral cavity of the user, wherein said main body includes, a teeth contact portion configured to be disposed on an outer surface of the row of teeth and which extends in a left-right direction, and a thin lip contact portion that connects said lip contact portion to said teeth contact portion and is configured to be contacted by the upper and lower lips, wherein said teeth contact portion is formed entirely and integrally from a flexible material, said teeth contact portion takes a wide sheet form that is thin in a front-rear direction and has a relatively enlarged dimension in an up-down direction, and said wide sheet form of the teeth contact portion has a deforming portion that is deformed easily in said up-down direction by providing large penetrating openings defined by at least three narrow frame portions having substantially equal widths, each of the equal widths being defined in a direction extending away from the large penetrating openings.

12. The tool according to claim 11, wherein the teeth contact portion has a first surface formed with a plurality of semi-arc shapes.

13. The tool according to claim 12, wherein the teeth contact portion has a second surface that is opposite from the first surface of the teeth contact portion, the second surface formed with a plurality of semi-arc shapes.

* * * * *